United States Patent [19]

Weidenhaupt et al.

[11] Patent Number: 4,601,165

[45] Date of Patent: Jul. 22, 1986

[54] METHOD OF MANUFACTURING A COMPACT, MULTILAYER SINGLE STRAND REINFORCING CORD FOR USE IN ELASTOMERIC PRODUCTS AND A CORD PRODUCED BY THIS METHOD

[75] Inventors: Wolfgang Weidenhaupt, Erkelenz; Günter Wepner, Waldfeucht-Neuhaaren; Peter Dismon, Heinsberg-Porselen, all of Fed. Rep. of Germany

[73] Assignee: Akzo NV, Arnhem, Netherlands

[21] Appl. No.: 742,548

[22] Filed: Jun. 7, 1985

[30] Foreign Application Priority Data

Jun. 7, 1984 [DE] Fed. Rep. of Germany ..... 3421118

[51] Int. Cl.[4] ..... D07B 1/06; D07B 3/00; D02G 3/48

[52] U.S. Cl. ..... 57/213; 57/13; 57/15; 57/902

[58] Field of Search ..... 57/200, 210, 212, 213, 57/214, 215, 230, 235, 3, 6, 9, 12, 13, 14, 15, 311, 902

[56] References Cited

U.S. PATENT DOCUMENTS

| | | | |
|---|---|---|---|
| 447,392 | 3/1891 | Wilson | 57/138 |
| 3,347,005 | 10/1967 | Preston | 57/213 X |
| 3,396,522 | 8/1968 | Bigini | 57/15 |
| 3,448,569 | 6/1969 | Brown et al. | 57/15 |
| 3,778,993 | 12/1973 | Glushko et al. | 57/215 |
| 3,872,659 | 3/1975 | Campbell et al. | 57/138 X |
| 4,332,131 | 6/1982 | Palsky et al. | 57/213 |

FOREIGN PATENT DOCUMENTS 2934012 3/1980 Fed. Rep. of Germany .

*Primary Examiner*—Donald Watkins
*Attorney, Agent, or Firm*—Michael J. Striker

[57] ABSTRACT

A reinforcing cord for elastomeric products is produced by feeding a plurality of single metal wires of the same diameter into a set of successively arranged stranding points. At least two wires are fed into the first stranding point and through the subsequent stranding points. Additional wires are fed into the respective subsequent stranding points. The quantity of wires fed to the stranding points is determined by the number of valleys which are present in the peripheral contour of the processed strand at this particular stranding point. In this manner each additional wire is brought in contact with at least two preceding wires in the processed strand.

16 Claims, 7 Drawing Figures

METHOD OF MANUFACTURING A COMPACT, MULTILAYER SINGLE STRAND REINFORCING CORD FOR USE IN ELASTOMERIC PRODUCTS AND A CORD PRODUCED BY THIS METHOD

BACKGROUND OF THE INVENTION

The present invention relates to a method of manufacturing a compact, multilayer, single strand reinforcing cord for elastomeric products in a stranding process in which metal wires of the same diameter are fed in a plurality of stranding points arranged one after the other whereby two or more metal wires are fed in the first stranding point or a single metal wire is fed through the first stranding point and six metal wires are fed into the second stranding point. This invention also relates to a reinforcing cord produced by this method.

A method of this kind and reinforcing cords produced by such a method are known from the German publication No. DE-OS 29 34 012. In this known method a stranding point is provided for each layer of metal wires. In order to guarantee that the individual metal wires in a completed cable formation occupy approximately the intended location, the metal wires are first jointly subject to a dummy twist before they are fed to the actual stranding device. The provision of the dummy twist should also insure that depending on the position of the individual metal wires in the completed cable formation the requisite length of each metal wire is supplied. In addition, the corresponding length of each metal wire is safeguarded by controlled rollers whose rotary speed is dependent on stress.

In this known method, however, when manufacturing reinforcing cords having more than two layers it cannot be guaranteed that each metal wire settles always in the intended position with respect to the underlying layer and accordingly it has been found that in reinforcing cords produced according to the the prior art method and exchange of locations of the metal wires over a length of the cord takes place. This exchange of locations has the consequence that the resulting reinforcing cord becomes less compact. Moreover, the equalization in length between individual metal wires cannot be maintained with sufficient accuracy. If the individual metal wires exhibit excessive length then in further processing, for example during laying or reeling, the small folds are shifted together into large carpet like folds and such folds then protrude in the form of loops from the cable binding or formation.

SUMMARY OF THE INVENTION

It is therefore a general object of the present invention to overcome the abovementioned disadvantages.

In particular, it is an object of this invention to provide such an improved manufacturing method and an improved reinforcing cord in which excessive length of individual wires in the completed cable formation are effectively avoided.

In keeping with these objects and others which will become apparent hereinafter, one feature of this invention resides, in the steps of feeding two or more metal wires into the first stranding point, and then determining exactly the position of additional metal wires in such a manner that in the subsequent stranding points only as many additional metal wires are fed as many valleys are formed in the peripheral contour of the processed cord at the corresponding stranding point whereby each additional wire is brought in contact with at least two preceding wires in the processed cord.

In the case when a single metal wire is fed into the first stranding point and to the second stranding point six metal wires are applied, the position of additional metal wires can be determined exactly in the above described manner, namely as to the stranding points after the second stranding point at most as many additional metal wires are supplied as many deepenings valleys are available at which each additional metal wire can be brought in contact with at least two metal wires already present in the strand.

According to another feature of the method of this invention, the metal wires are no longer laid in layers. Instead, to each stranding point at most as many metal wires are applied as many stable deposition points or valleys are formed in the already processed basic core of the cable. In this manner, further stable depositing points in the basic core are created which serve for the deposition of additional wires in the subsequent stranding point. A stable depositing point according to the method of this invention always results when a newly applied metal wire is brought in contact with at least two previously stranded metal wires. In other words, the newly applied wire is laid on the valley or notch delimited by at least two adjacent previous wires and therefore the new wire is spatially fixed in position.

Inasmuch as in the method of this invention metal wires fed into each stranding point are laid in stable depositing locations, the length required for each individual metal wire can be simply and exactly predetermined by computation and the metal wire can be fed in its stranding point with the corresponding overlength. The excessive length needed for respective wires can be computed from the desired configuration of the completd reinforcing cord as it will be explained in detail below.

The provision of the requisite overlength is with advantage achieved by a corresponding preforming of the metallic wires. The preforming of the wires is preferably made by bending the wires over nipples, pins or edges. If a nipple, pin or edge tends the wire in cycles then the resulting metal wire is preformed into a helix. If the bending is performed always at the same points on the circumference of the wires and when the wire is once more bent in opposite direction at a distance from the first bending point then the wire is preformed into a planar wave. The exact length of a metal wire in an outer layer can be determined from the pitch and diameter of the helically shaped wire or from the amplitude and wavelength of the waveshaped wire.

The preforming of metal wires can be also made by the application of torque. In this case the supply spools from which the wires are taken off must be rotated so that during the feeding each wire is twisted.

Further advantage of the method of this invention is to be seen also in the fact that in manufacturing a compact, multilayer single strand reinforcing cord a dummy twisting of the cable formation is no longer necessary, in contrast to prior art methods. In addition, the reinforcing cords manufactured according to this novel method distinguish themselves by their compactness. The component wires in the completed reinforcing cord, when viewed over the length of the latter, always occupy the same location. The preforming of the wires prior to their feeding in the stranding points does not produce any detrimental effects in the completed cord inasmuch as this preforming is again neutralized during the actual stranding process, for example in a double lay twisting machine.

In the preferred embodiment, the reinforcing cord of this invention consists of at least twelve component wires of the same diameter and having an innermost layer consisting of one up to four individual wires and wherein each wire has always the same relative position in the cross-section, the cord being produced by feeding respective wires into a plurality of stranding points arranged one after the other whereby either two through four or one and then six single wires are applied in the first stranding point and then as many wires are applied to the subsequent stranding point as many valleys are formed in the circumference of the innermost layer so that each additional metal wire is brought in contact with at least two preceding wires in the processed strand.

In this reinforcing cord, the length of respective wires per length of lay of the reinforcing cord increases in dependency on their radial position in cross-section of the cord.

Of particular advantage is a reinforcing cord in which outer wires are mostly in a linear contact with three and the inner wires with six other wires over the entire length of the cord.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
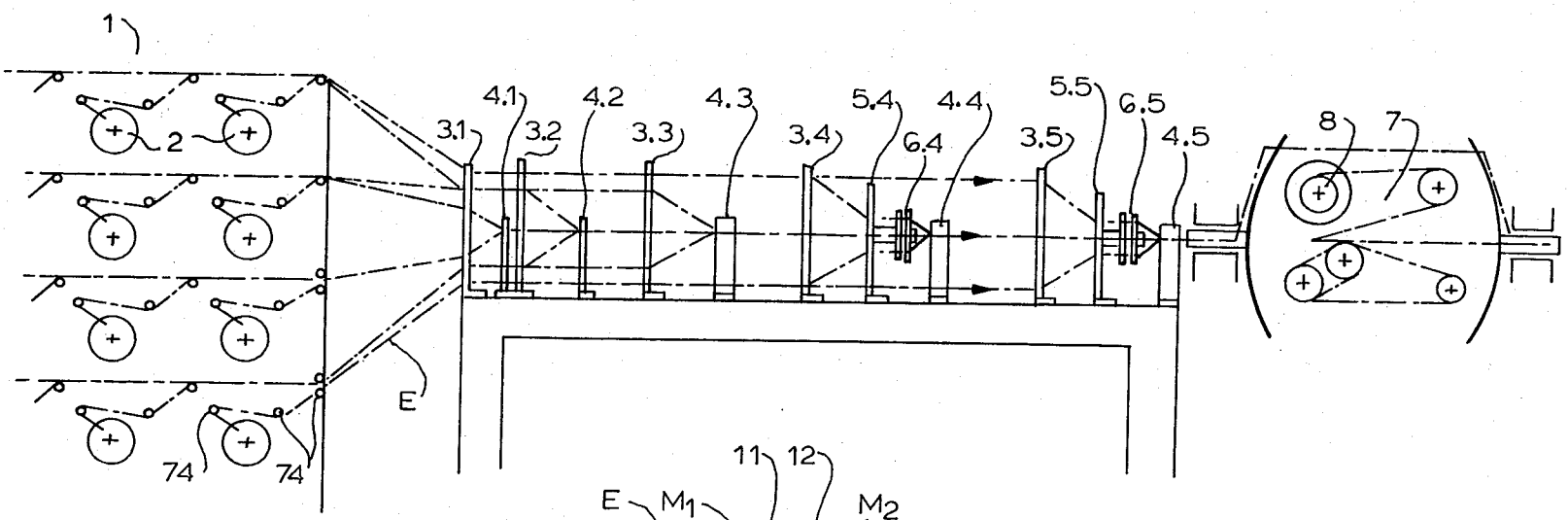
FIG. 1 is a side view of schematically illustrated device for the manufacture of a reinforcing cord according to this invention.

FIG. 1 illustrates a device for manufacturing a reinforcing cord by the method of this invention. Reference numeral 1 indicates a discharging frame with a plurality of wire supply spools 2. For the sake of simplicity, the discharging or delivery frame is shown with eight supply spools 2 only. Individual wires E are taken off the spools and fed past guiding elements 14 into a stranding device. The stranding device in this example includes five wire deflecting stations 4.1 through 4.5 arranged one after the other in the wire feeding direction and each establishing a stranding point. Before each wire deflecting station 4.1 through 4.5 there are provided distributing plates 3.1 through 3.5 which are in the form of perforated plates provided with non-illustrated guiding nipples. The wire deflecting stations 4.3 through 4.5 must be of a stronger construction as indicated in the drawing by their increased width. The stations 4.3 through 4.5 include, apart from the centering nipple constituting the stranding point, also pressing jaws (non-illustrated). In front of the wire deflecting stations 4.4 and 4.5 are arranged respectively graduated wire preforming heads 6.4 and 6.5 through which the wires each are fed from distributing plates 5.4 and 5.5. After discharge from the last wire deflecting station 4.5 the concentrated or stranded wires are processed in a double lay twisting machine 7 (outer/inner twist) in which the centralized wires are twisted into a compact, multilayer, single strand reinforcing cord which is wound up on a cable spool 8.

Figure 2:
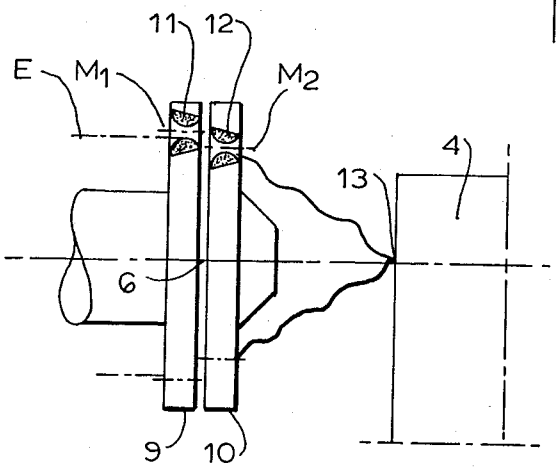
FIG. 2 is a side view of a schematically illustrated wire preforming device for the device of FIG. 1, shown on an enlarged scale.

FIG. 2 illustrates schematically on an enlarged scale a stepped wire preforming head 6. Depending whether a stopper is arranged before the preforming head, the wires are either preformed into a planar waveshaped line (with the twist stopper) or into a helical line (without twist stopper). The stepped preforming head 6 consists essentially of two discs 9 and 10 in which preforming eyelets 11 and 12 are arranged at different levels in arcs $M_1$ and $M_2$. For each individual wire E which is to be preformed in the head 6, there is provided a pair of preforming eyelets 11 and 12. Each preforming eyelet has an edge by which the component wire E is successively bent. The degree of preforming is determined by the size of the gap between the discs 9 and 10, by the gradation of the diameters of arcs $M_1$ and $M_2$ and by the angle of rotational stagger formed between the cooperating preforming eyelets 11 and 12. The preformed component wires are concentrated in the wire deflecting station 4 and the stranding point 13.

Figure 3:
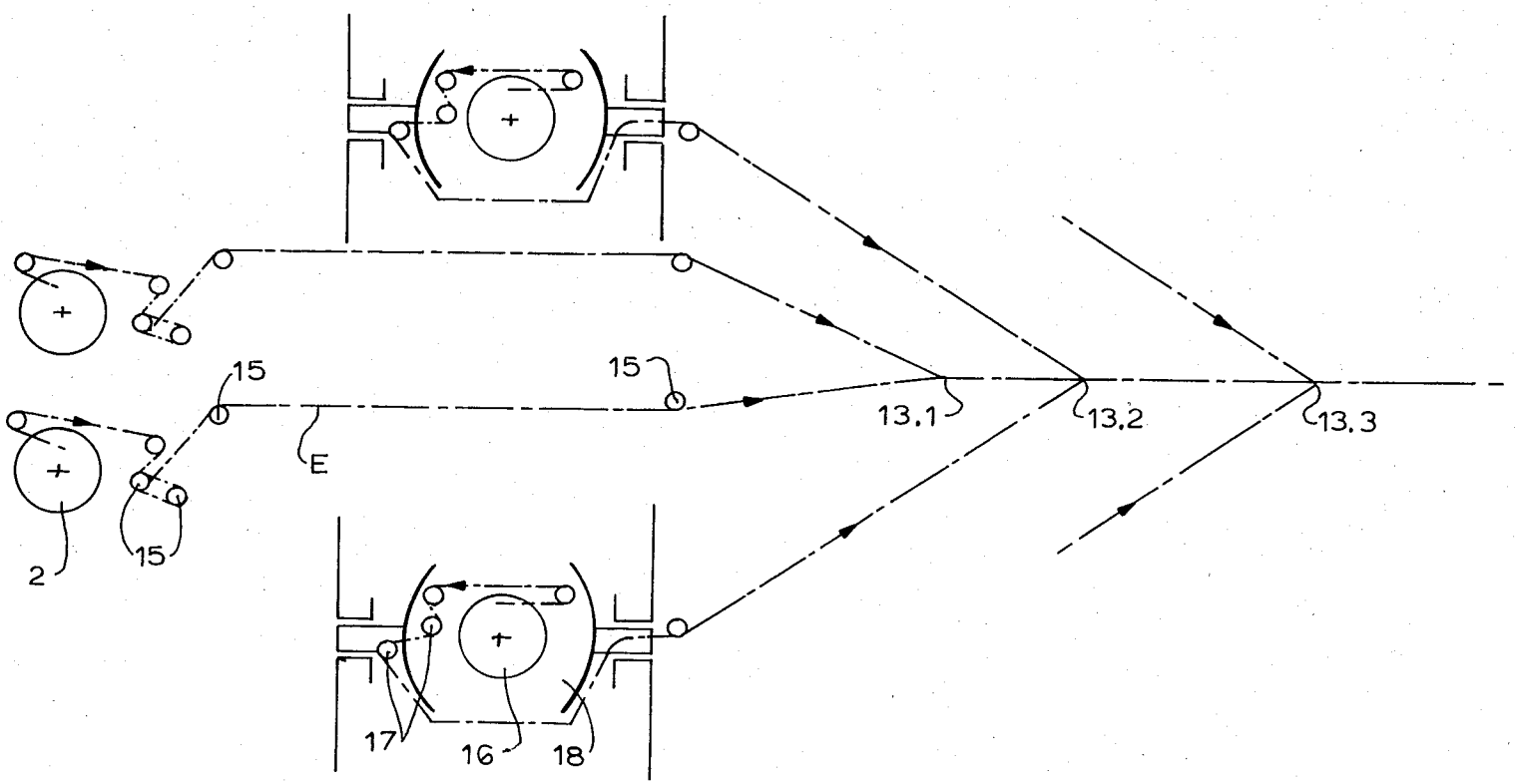
FIG. 3 is a side view of a schematically illustrated supply device for individual wires in the device of FIG. 1, shown on an enlarged scale.

FIG. 3 illustrates two different embodiments of offtake or supply spcols for individual wires. The design of the takeoff arrangement is such that individual wires E are taken off tangentially from spools 2 and applied to stranding point 13.1. Other offtake or supply spools 16 are arranged in rotatably supported twisting devices through which individual wires 18 are withdrawn in accordance with known Arundel-method and are preformed by torsion. Wires 18 are guided on guides 17 mounted on the twister, to a stranding point 13.2. The preforming of the wires by torsion if desired can be combined with the preforming by means of stepped preforming heads 6 described before. The purpose of the two wire takeoff devices is to provide the necessary overlength to individual wires in accordance with their intended position in the completed cord. Wires 18 preformed by torsion on other non-illustrated twisters are supplied to subsequent stranding points 13.3.

Figure 4:
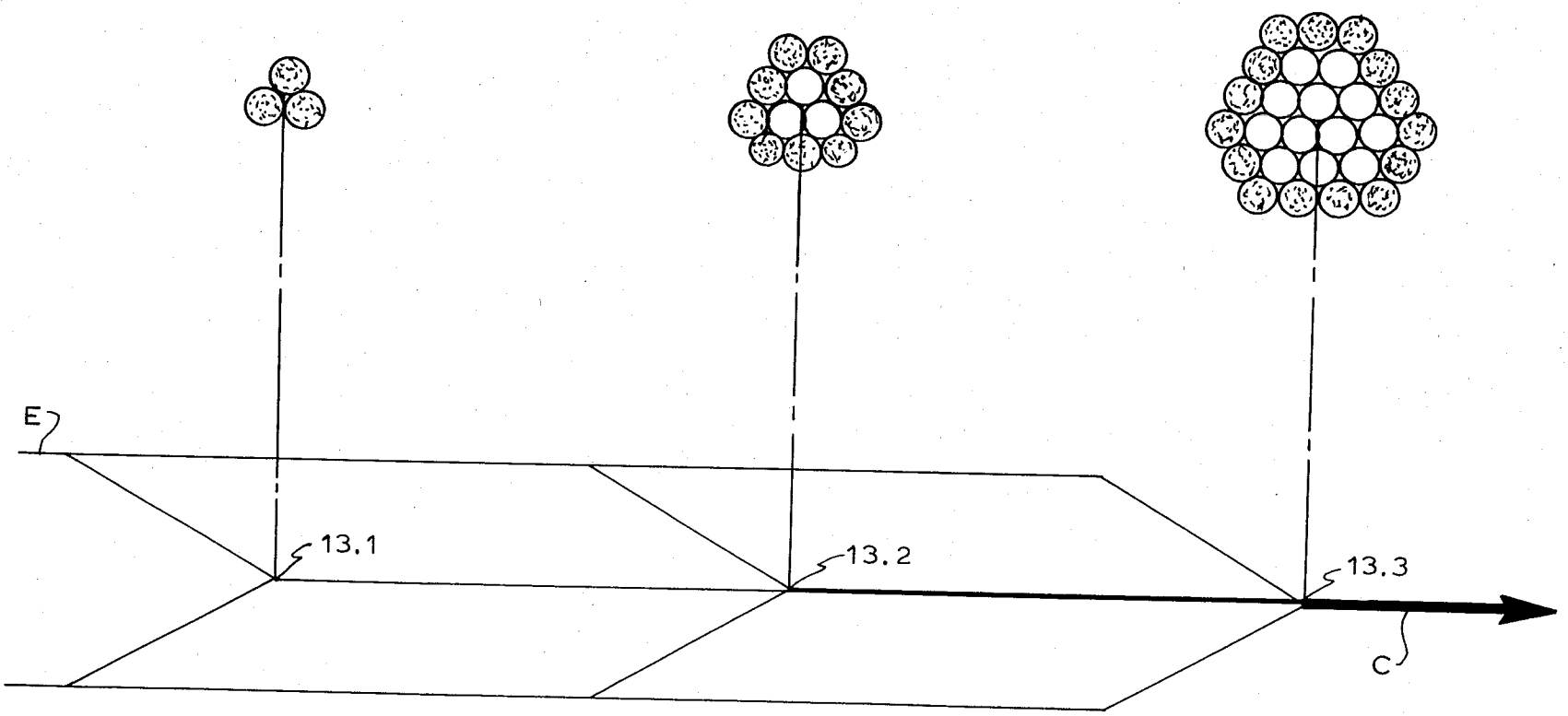
FIG. 4 is a schematic illustration of a prior art stranding process.

FIG. 4 shows schematically a prior art method of feeding individual wires in a strand in a layer-like fashion as described in the German publication No. DE-OS 29 33 012. In this example, in order to manufacture a compact multilayer single strand reinforcing cord, there are used 27 individual wires which are fed into three stranding points 13.1 through 13.3. Three wires E are applied to the first stranding point 13.1, nine wires are fed to the second stranding point 13.2 and fifteen wires are fed to the third stranding point 13.3. The upper part of FIC. 4 shows in cross-section the intended layers of wires in a cross-section of the processed strand. Black circles denote those wires which pertain to the corresponding stranding point while white circles indicate those wires which have been already fed in the preceding stranding point or points.

Figure 5:
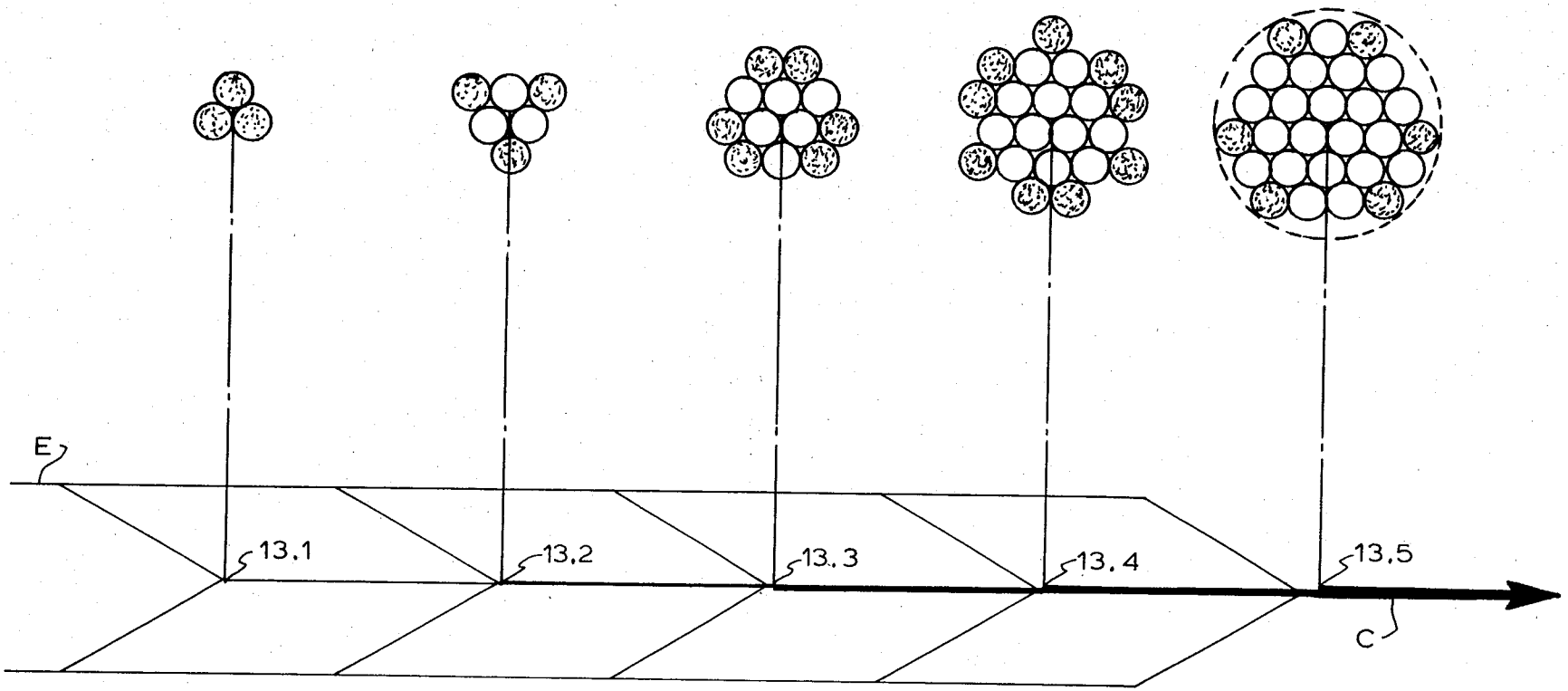
FIG. 5 is a schematic illustration of the stranding process according to this invention.

FIG. 5 shows schematically the wire stranding method according to this invention using five stranding points 13.1 through 13.5. From the cross-sections of the processed strands above respective stranding points it is apparent that as many wires (black circles) are supplied to stranding points after the first stranding point 13.1, as many valleys are formed in the peripheral contour of the previously supplied metal wires (white circles) in which the additionally supplied wires (black) can be brought in contact with at least two previous wires. In this example, three wires are fed in the second stranding pint 13.2, six wires into the third stranding point 13.3, and nine additional wires are fed in the fourth stranding point 13.4. If the completed cord is supposed to consist again of twenty-seven component wires the last six wires are applied to the last stranding point 13.5 whereupon the resulting processed strand or cord C is twisted into a completed cord.

The particular overlength of wires which are required in respective layers can be accurately computed as it will be described in the following description.

Figure 6:
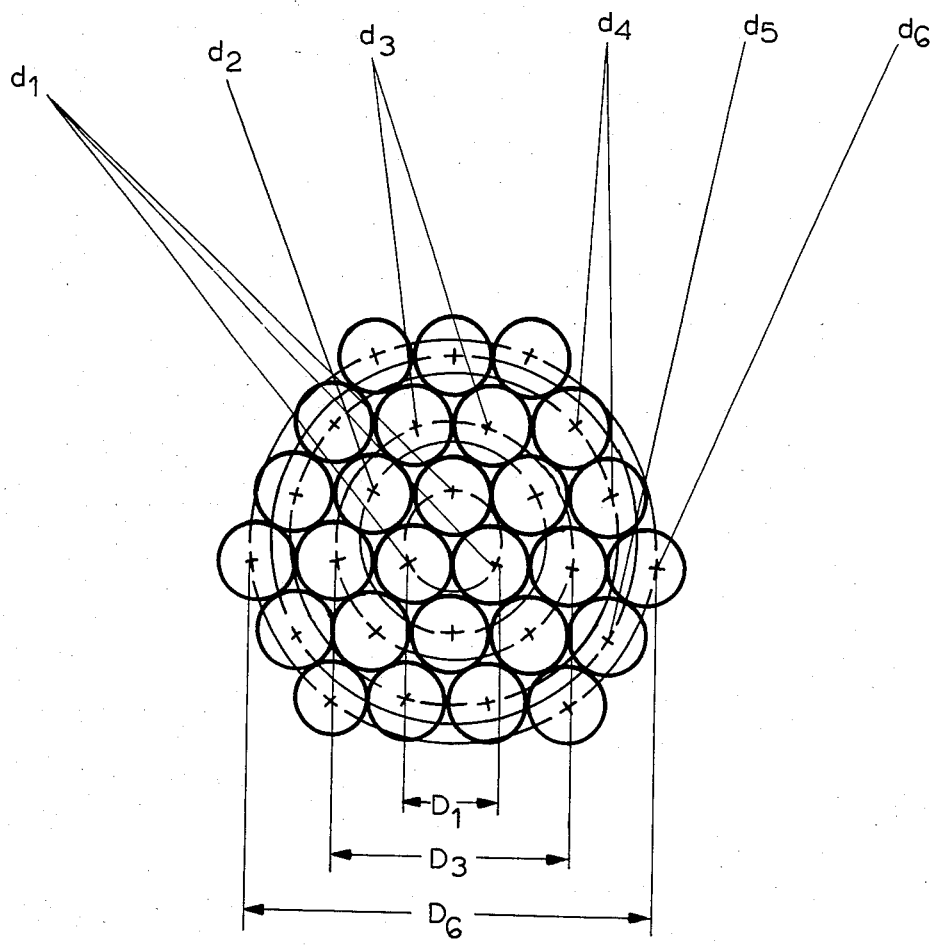
FIG. 6 is a cross-section of a reinforcing cord of this invention with indicated concentric circles intersecting the centers of wires in respective layers and serving for the computation of overlength of individual wires.

FIG. 6 illustrates a cross-section of a reinforcing cord which again consists of twenty seven component wires and having a center core consisting of three wires $d_1$ whose centers are located on a circle of a diameter $D_1$. Three additional component wires $d_2$ have their centers located on a circle of a diameter $D_2$ which is concentric with the circle $D_1$. The subsequent layers of components wires are arranged as follows: six component wires $d_3$ have their centers located on concentric circle $D_3$, six components $d_4$ have their centers located on a concentric circle $D_4$, three components wires $d_5$ are centered on a concentric circle $D_5$ and six component wires $d_6$ are centered on the outermost circle $D_6$.

The determination or computation of the requisite overlength of the wires in respective layers is made by way of an example as follows:

The computation is made for a reinforcing cord of the design type 27×0.22, that means the reinforcing cord consists of 27 component wires of 0.22 mm of diameter. This cord type is constructed of three different wire layers:

| | |
|---|---|
| First layer: | 3 × 0.22 |
| Second layer: | 9 × 0.22 |
| Third layer: | 15 × 0.22 |
| Construction: | 27 × 0.22 |

The length of lay and the direction of lay must be the same for all three wire layers. The rope or cord is manufactured in a single working process of 27 individual wires on an outer-inner twisting machine as shown in FIGS. 1 and 5.

The twisting factor En (effective wire length equals the length of lay) is different for all three wire layers and additional differences result in the second and third wire layers from the position of respective wires.

The angle of lay of individual wire groups is computed as follows:

$$tg\,\alpha\,n = \frac{Dn \times \pi}{S}$$

whereby $D_n$ is the neutral diameter of the for each group of wires and S denotes the length of lay (FIG. 6).

From the equation $$E_n = \frac{1n}{S} = \frac{1}{\cos\alpha\,n}$$

the binding factor $E_n$ of the wires in the rope computed.

As it will be seen from FIG. 6, for a cord construction 27×0.22 series of neutral rope diameters results designated by concentric circles $D_1$ through $D_6$. Within the nine wire formation of the second layer there are two different wire groups having different neutral rope diameters ($D_2$ and $D_3$). In the fifteen wire formation of the third layer there are three different neutral rope diameters ($D_4$ through $D_6$).

The following table I presents a survey of different threadings or twists for the different wire layers and wire groups in a 27×0.22 cord.

For the neutral rope diameters $D_n$ of respective wire groups the following equations are valid for a 27×d rope construction:

$$D_1 = 2d \times tg\,30°$$

$$D_2 = 2d \times \frac{1}{\cos 30°}$$

$$D_3 = d \times \sqrt{1 + 25\,tg^2\,30°}$$

$$D_4 = 2d \times \sqrt{4 + tg^2\,30°}$$

$$D_5 = 8d \times th\,30°$$

$$D_6 = 2d \times \sqrt{1 + 16 \times tg^2\,30°}$$

wherein d is the diameter of respective wires.

Table I shows that in the wire group 6 of the fifteen wire formation ($D_4$ through $D_6$) the wire length of 18.333 mm for a length of a lay 18.0 mm is required, whereas for the three wire formation of the wire group 1 only 18.018 mm are required for the same lay length. Accordingly, the three wire formation of group 1 after twisting exhibits an overlength of 1.75% with respect to the wires of the group 6. The other wire groups have correspondingly smaller overlength in relation to the wire group 6. The wire overlength of the three wire formation might cause a shift of small folds resulting during the subsequent processing of the completed rope, for example during straightening due to dummy twisting effects, takeup stress and the like, into a carpet-like combined fold which might protrude from the rope formation in the form of a loop. This overlength effect can be eliminated by the suitable preforming of the individual wires.

TABLE I

| Computation of Twisted Wire Lengths for 27 × 0.22 Cord | | | | | | | | | |
|---|---|---|---|---|---|---|---|---|---|
| | | | Angle of twist [°] | | | | | Required | |
| | Wire | | 1. twist | 2. twist | Binding Factor E | | Dn | Wire Length | Wire overlength |
| Wire layer | group | Designation | 36.0 mm | 18.0 mm | 1. twist | 2. twist | mm | 1 mm | Δ1/1 100 |
| 3 × 0.22 | 1 | 3 × 0.22 | 1.27 | 2.54 | 1.0002 | 1.0010 | 0.2540 | 18.018 | 1.75 |
| 9 × 0.22 | 2 | 3 × 1 × 0.22 | 2.54 | 5.07 | 1.0010 | 1.0039 | 0.5081 | 18.071 | 1.45 |
| | 3 | 3 × 2 × 0.22 | 3.36 | 6.69 | 1.0017 | 1.0069 | 0.6721 | 18.123 | 1.16 |
| 15 × 0.22 | 4 | 3 × 2 × 0.22 | 4.57 | 9.08 | 1.0032 | 1.0127 | 0.9159 | 18.229 | 0.57 |
| | 5 | 3 × 1 × 0.22 | 5.07 | 10.06 | 1.0039 | 1.0156 | 1.0161 | 18.281 | 0.28 |
| | 6 | 6 × 1 × 0.22 | 5.52 | 10.94 | 1.0047 | 1.0185 | 1.1073 | 18.333 | 0 |

Figure 7:
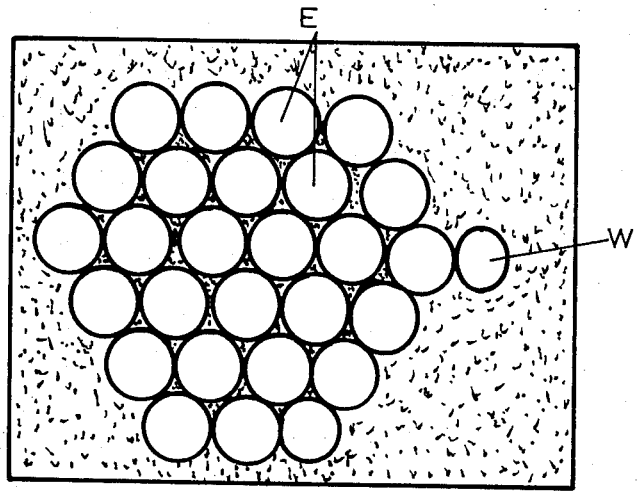
FIG. 7 is a microscopic photograph of a cross-section of a reinforcing cord according to this invention.

By using the method of this invention very compact, multilayer single strand reinforcing cords are achievable as it is apparent from the microphotograph of FIG. 7.

The microscopic picture shows cross-section of an actual reinforcing cord of the construction type 27×0.22+0.15 F produced in accordance with this invention. The reinforcing cord consists of 27 component wires E each having a diameter of 0.22 mm and also includes a wrap around wire W of a diameter 0.15 mm, the latter being for improving the compactness of the cord rolled flat. In making the microscopic photograph a sample of the cord of this invention was cast integral in a block of plastic material. After hardening of the plastic bloc the latter was cut perpendicularly to the axis of the reinforcing cord. Subsequently, the sectional surface was ground and polished. The specimen produced in this way was photographed through microscope to produce the illustrated enlargement.

It will be seen from FIG. 7 that the reinforcing cord of this invention has a very uniform configuration of its cross-section and a stable position of component wires resulting consequently into a compactness of the finished cord which cannot be surpassed. The compact cords of this invention in comparison with conventional layer type construction of cords has the following advantages:

Producability in a single manufacturing process;
Smaller diameter of the finished cord;
Smaller stranding losses, that is higher strength of the cord;
Higher apparent strength of the cord
Better fatigue values;
Smaller weight per meter;
Higher specific strength; and
Distinctly reduced permeability to air.

These advantages are exemplified in the following Table II.

EXAMPLES

Different cords A, B, C were produced according to the method of this invention. In cord A, three component wires of diameters 0.22 mm were fed into the first stranding point, three component wires of the same diameter were applied into the second stranding point and six component wires of the same diameter were applied into the third stranding point.

In cord B and C three wires were fed into the first stranding point, three wires into the second stranding point, six wires into the third, nine wires into the fourth, and six wires were applied into the fifth stranding point, the wires being of the same diameter of 0.175 mm (cord B) and 0.22 mm (cord C). Wires fed into the second and third stranding points exhibit overlength corresponding to the design position in the cord formation, the overlength being established by the beforedescribed preforming of the wires into a wavy shape during their feeding into the stranding point. The overall construction characteristics of the cords produced in accordance with this invention are apparent from the Table II.

All cords listed in the table are provided with a wrapping wire of 0.15 mm in diameter. For comparison, Table II includes also commercially available cords X, Y and Z of layer like construction manufactured according to prior art method. Listed are parameters both of the known cords of layer like construction as well as of the cord produced according to the method of this invention. These parameters are diameters of the final products (average values), rupture load, apparent strength, rigidity according Taber, fatigue according to de Mattia, weight per meter, specific strength and air permeability in embedded condition. The permeability to air was measured according to the method described in the German publication No. DE-OS 32 15 506. The Table II shows impressively to which extend the above mentioned advantages of cord A, B, C manufactured in accordance with this invention are attained in comparison with prior art cords X, Y, Z produced in conventional layer type construction.

For example the diameter of A of this invention has a diameter reduced by 4.3% in comparison to the diameter of prior cord X produced in conventional layer like design; cord B of this invention has a diameter reduction of about 4.5% with respect to the cord Y in conventional layer type construction; and cord C has a diameter reduction of about 3.1% when compared to the known cord Z.

TABLE II

| Cord | X | A | Y | B | Z | C |
|---|---|---|---|---|---|---|
| Designation | 3 + 9x 0.22 + 0.15 | 12x 0.22 + 0.15 | 3 + 9 + 15x 0.175 + 0.15 | 27x 0.175 + 0.15 | 3 + 9 + 15x 0.22 + 0.15 | 27x 0.22 + 0.15 |
| Direction of laying | S/S/Z | Z/S | S/S/Z/S | Z/S | S/S/Z/S | Z/S |
| Length of laying | 6/12/3.5 | 12.5/3.5 | 5/10/ 16/3.5 | 16/3.5 | 6/12/ 18/3.5 | 18/3.5 |
| Diameter of finished cord | 1.15 | 1.10 | 1.33 | 1.27 | 1.61 | 1.56 |
| Rupture load N | 1210 | 1240 | 1740 | 1790 | 2740 | 2870 |
| Apparent strength n/mm$^2$ | 1164 | 1305 | 1252 | 1413 | 1345 | 1454 |
| Rigidity according Taber S.U. | 44 | 42 | 46 | 46 | 121 | 123 |

TABLE II-continued

| Cord | X | A | Y | B | Z | C |
|---|---|---|---|---|---|---|
| Rigidity according Mattia (Cylon) | — | — | 235.000 | 270.000 | — | — |
| m-weight Ktex | 3.80 | 3.72 | 5.47 | 5.33 | 8.50 | 8.35 |
| Specific strength N/ktex | 318 | 333 | 318 | 336 | 322 | 333 |
| Air permeability | 89 | 9 | 115 | 28 | 280 | 85 |

It will be understood that each of the elements described above, or two or more together, may also find a useful application in other types of constructions differing from the types described above.

While the invention has been illustrated and described as embodied in a specific example of a reinforcing cord for elastomeric products, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of manufacturing a compact, multilayer single strand reinforcing cord, particularly for use in elastomeric products, the cord being produced in a single stranding process in which a plurality of metal wires of the same diameter are fed into a set of stranding points arranged one after the other in the direction of advance of a processed strand, comprising the steps of feeding at least two and at most four wires into the first stranding point; feeding into the subsequent stranding points additional wires, whereby behind each stranding point adjacent peripheral portions of preceding wires delimit valleys in the contour of the processed strand, the number of said additional wires fed into respective subsequent stranding points before the last stranding point corresponding to the number of valleys present on the processed strand whereby each valley provides a stable deposition zone for a wire, and feeding into the last stranding point only as many additional wires as needed for a desired compactness of the resulting cord.

2. A method as defined in claim 1, further comprising the step of feeding respective wires into corresponding stranding points with overlengths depending on the desired position of each wire in the processed strand.

3. A method as defined in claim 2, wherein during the feeding of respective wires into the stranding points the wires are subject to a preforming process depending on the required overlength.

4. A method as defined in claim 3, wherein the preforming process is performed by bending individual metal wires over nipples, pins, edges and the like.

5. A method as defined in claim 3, wherein the preforming process is performed by torsion.

6. A method of manufacturing a compact, multilayer single strand reinforcing cord, particularly for use in elastomeric products, the cord being produced in a single stranding process in which a plurality of metal wires of the same diameter are fed into a set of stranding points arranged one after the other in the direction of advance of a processed strand, comprising the steps of feeding one wire into the first stranding point; feeding additional six wires into the second stranding point; and feeding into the subsequent stranding points behind the second stranding point additional wires, whereby behind the second and the subsequent stranding points adjacent peripheral portions of preceding wires delimit valleys in the contour of the processed strand, the number of said additional wires fed into said subsequent stranding points before the last stranding point corresponding to a number of valleys present on the processed strand whereby each valley provides a stable deposition zone for a wire, and feeding into the last stranding point only as many additional wires as needed for a desired compactness of the resulting cord.

7. A method as defined in claim 6, further comprising the step of feeding respective wires into corresponding stranding points with overlengths depending on the desired position of each wire in the processed strand.

8. A method as defined in claim 7, wherein during the feeding of respective wires into the stranding points the wires are subject to a preforming process depending on the required overlength.

9. A method as defined in claim 8, wherein the preforming process is performed by bending individual metal wires over nipples, pins, edges and the like.

10. A method as defined in claim 8, wherein the preforming process is performed by torsion.

11. A multilayer, single strand, compact reinforcing cord particularly for use in elastomeric products, comprising at least twelve metal wires of the same diameter and in which each wire occupies the same relative cross-sectional position over the entire length of the cord; the cord being produced by feeding two or at most four wires into a first stranding point; feeding into the subsequent stranding points additional wires forming inner layers, whereby behind each stranding point adjacent peripheral positions of preceding wires delimit valleys in the contour of processed strand, the number of the additional wires behind the subsequent stranding points corresponding to the number of valleys present on the processed strand and each valley providing a stable deposition zone for a wire over the entire length of the cord; and the number of the additional wires fed into the last stranding point to form an outer layer corresponding to a number of valleys delimited by three adjoining wires on the strand.

12. A multilayer, single strand, compact reinforcing cord particularly for use in elastomeric products, comprising at least twelve metal wires of the same diameter and in which each wire occupies the same relative cross-sectional position over the entire length of the cord; the cord being produced by feeding one wire into a first stranding point; feeding addditional six wires into a second stranding point; feeding into subsequent stranding points behind the second stranding ooint and before a last stranding point additional wires forming inner layers, whereby behind the second and the subsequent stranding points adjacent peripheral portions of preceding wires delimit valleys in the contour of the processed strand, the number of said additional wires corresponding to the number of valleys present on the processed strand and each valley providing a stable deposition zone for a wire over the entire length of the cord; and an outer layer of the strand behind the last stranding point containing only as many additional wires as needed for a desired compactness of the cord.

13. A reinforcing cord as defined in claim 12, wherein the length of individual wires per a length of lay of the cord increases in dependency on the relative position of the wires in the cross-section of the cord from the inner layers toward the outer layer.

14. A reinforcing cord as defined in claim 13, wherein over the entire length of the cord the wires in the outermost layer are in linear contact with three underlying wires and the inner wires are in contact with six other wires.

15. A reinforcing cord as defined in claim 11, wherein the length of individual wires per a length of lay of the reinforcing cord increases in dependency on the relative position of the wires in the cross-section of the cord from the inner layers toward the outer layers.

16. A reinforcing cord as defined in claim 15, wherein over the entire length of the cord the outermost wires are in linear contact with three underlying wires and the inner wires are in contact with six other wires.

* * * * *